United States Patent [19]

Kasuda et al.

[11] Patent Number: 4,674,426

[45] Date of Patent: Jun. 23, 1987

[54] FEED MECHANISM FOR SEWING MACHINE

[75] Inventors: Takashi Kasuda; Youji Seto, both of Osaka, Japan

[73] Assignee: Pegasus Sewing Machine Mfg. Co., Ltd., Osaka, Japan

[21] Appl. No.: 753,253

[22] Filed: Jul. 9, 1985

[30] Foreign Application Priority Data

Jul. 11, 1984 [JP] Japan ..... 59-105513[U]

[51] Int. Cl.[4] ..... D05B 27/02

[52] U.S. Cl. ..... 112/313; 112/314

[58] Field of Search ..... 112/313, 314, 312, 315, 112/316, 323

[56] References Cited

U.S. PATENT DOCUMENTS

| | | | |
|---|---|---|---|
| 2,102,202 | 12/1937 | Ebert | 112/313 |
| 2,341,448 | 2/1944 | Knaus | 112/313 |
| 2,771,848 | 11/1956 | Knaus et al. | 112/313 |
| 4,469,039 | 9/1984 | Marchesi | 112/313 X |

*Primary Examiner*—H. Hampton Hunter

*Attorney, Agent, or Firm*—Flynn, Thiel, Boutell & Tanis

[57] ABSTRACT

A lifting rocker which is pivotally supported by a link is engaged with an eccentric ring which is fixed to a main shaft of a sewing machine. By the rotation of the eccentric ring, the lifting rocker rocks up and down about a fulcrum defined by the link while causing the link to rock. A feed bar having thereon a feed dog is slidably supported by the lifting rocker, and moves in back and forth directions through the rocking of the arm to constantly maintain a definite amount of feed without respect to variation of the rotational speed of the main shaft of the sewing machine.

8 Claims, 5 Drawing Figures

FIG. 4
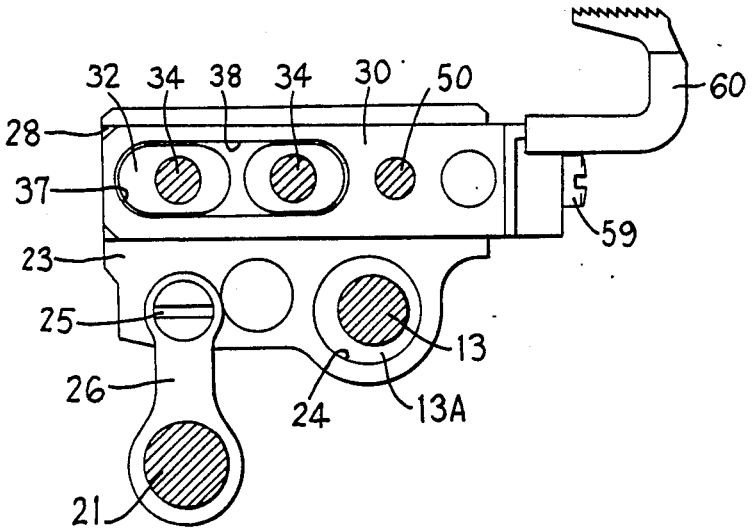
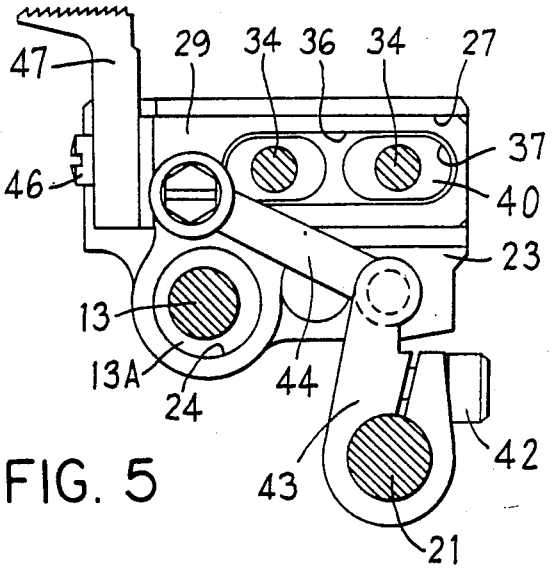
FIG. 5

FEED MECHANISM FOR SEWING MACHINE

FIELD OF THE INVENTION

The present invention relates to a feed mechanism for a sewing machine which is particularly suitable for use as a differential feed mechanism for a high speed sewing machine.

BACKGROUND OF THE INVENTION

In conventional sewing machines there are employed various reciprocal motion mechanisms such as a reciprocal linear motion mechanism a rocking motion mechanism. In such mechanisms, as the sewing machine is operated at a high speed, its inertia force is increased, with the result that the amount of movement tends to increase at the time of the high speed operation rather than at the time of the low speed operation. Especially, in the feed mechanisms in conventional high speed sewing machines, due to the large weight of the feed bar which supports the feed dog and is connected with the mechanism to move the feed dog back and forth and the mechanism to move it up and down, the amount of movement of the feed dog becomes larger in high speed operation than in low speed operation to provide a phenomenon of making the cloth feeding amount larger. Accordingly, the cloth feeding amount gradually increases during the time from the start of the sewing machine to the time of the high speed operation, and unevenness is apt to be produced in seams.

SUMMARY OF THE INVENTION

An object of the present invention is to reduce the weight of the feed bar and lessen the difference of the feed amount between the high speed operation time and the low speed operation time. It is characterized by slidably fitting the feed bar to a lifting rocker and connecting the up and down motion mechanism of the feed dog with the lifting rocker, thereby omitting the connecting part for the up and down motion mechanism from the feed bar and reducing the weight of said feed bar.

Another feature of the present invention is, in a sewing machine furnished with a differential feed mechanism, slidably supporting a feed bar and a differential feed bar on a common lifting rocker so as to simplify the construction by using a single lifting rocker.

Another feature of the present invention is having a guide groove formed in the lifting rocker to receive the feed bar, and holding the exposed outer side surface of the feed bar with a fitting member fixed to the body, thereby alleviating the weight of the lifting rocker.

A further feature of the present invention is having guide grooves formed in both sides of the lifting rocker, supporting each of the feed bar and the differential feed bar in a respective guide groove, holding one of the two feed bars with the fitting member fixed to the body, forming inter-connecting slots in both feed bars and the lifting rocker respectively, projecting pins provided on the fitting member through the respective slots of the feed bar, lifting rocker, and differential feed bar, securing at the opposite ends of the pins a holding plate to support the other feed bar, providing the fitting member independently and separately from the lifting rocker, and forming the slots respectively in the lifting rocker and both feed bars, thereby further alleviating the weight.

Other features and advantages of the present invention will become apparent from the following description of the preferred embodiment given with reference to the accompanying drawings.

BRIEF DESCRIPTION OF THE DRAWINGS

FIG. 4 is a sectional view of the differential feed mechanism taken along the line IV—IV in FIG. 2; and FIG. 5 is a sectional view of the differential feed mechanism taken along the line V—V in FIG. 2.

DETAILED DESCRIPTION OF A PREFERRED EMBODIMENT

Figure 1:
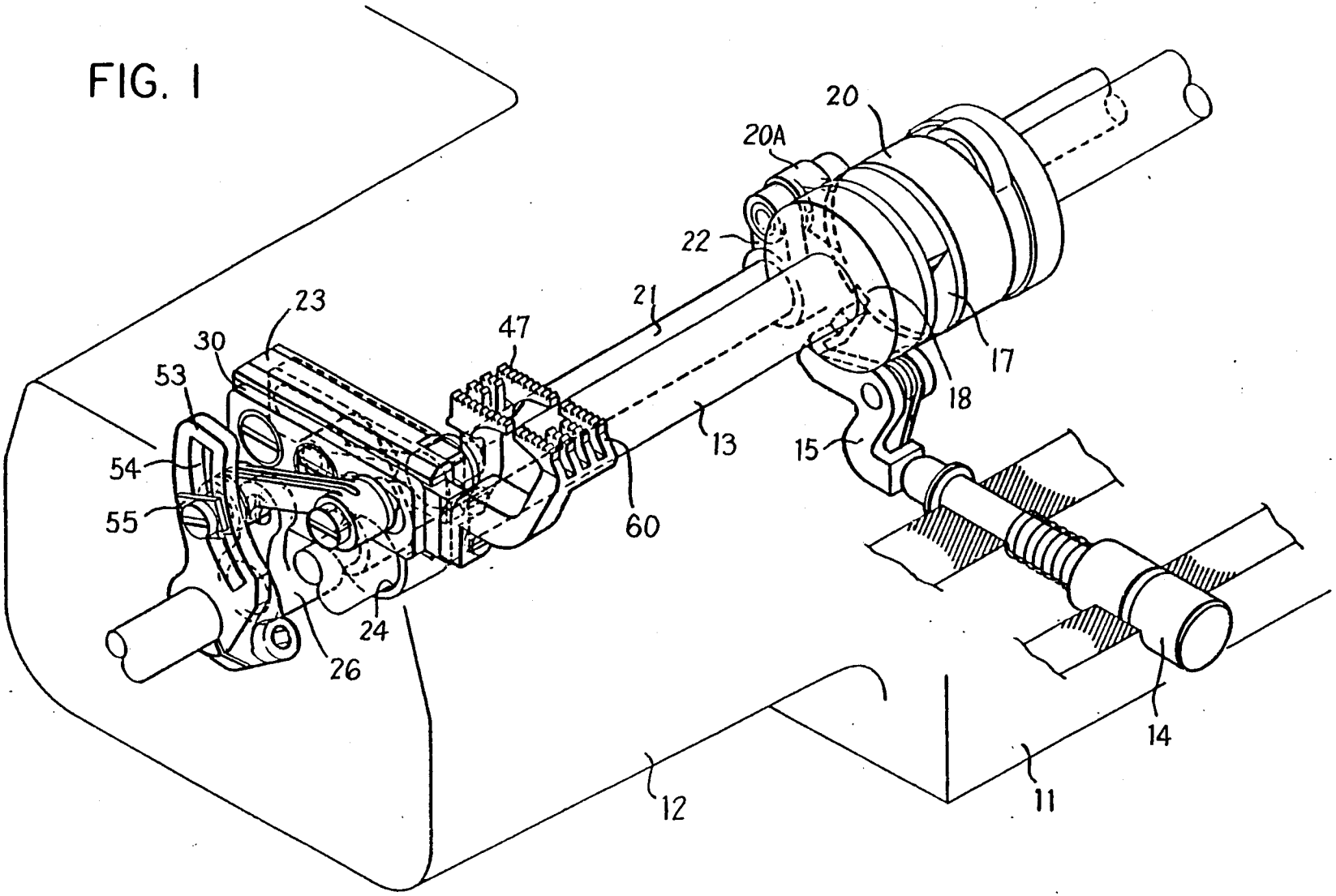
FIG. 1 is a perspective view of an eccentric mechanism and of a differential feed mechanism contained in the cylinder head of a sewing machine, and embodying the invention.
Figure 2:
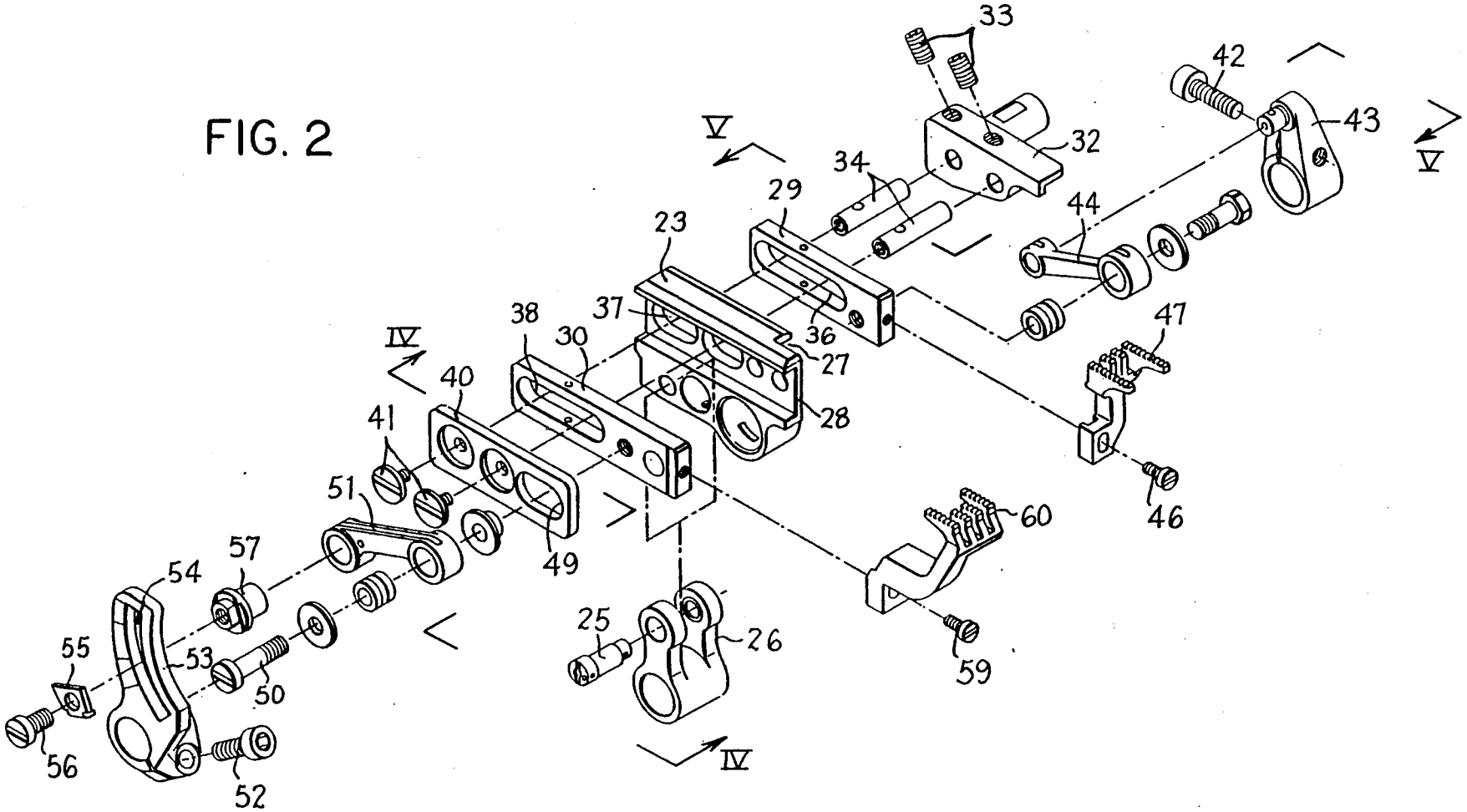
FIG. 2 is an exploded perspective view of the differential feed mechanism shown in FIG. 1

A body 11 of a sewing machine is furnished with a transversely projecting cylinder bed 12. Into the bed there is extended a main shaft 13 which is rotatably supported in the body and rotatably driven by a motor (not illustrated). The main shaft 13 has an eccentric ring (not shown). As is known, as to the eccentric ring, a push button 14 can be pushed to cause a bell crank shaped lever 15 to rotate and engage with one end a groove 18 formed in the peripheral surface of a disc 17 which is integral with said eccentric ring so as to lock the eccentric ring against rotation, followed by rotating the main shaft 13, by which the effective eccentricity is adjusted.

The eccentric ring is externally surrounded by an end of a rod 20. The other end 20A of the rod is pivotally supported by a crank 22 which is fixed to a feed shaft 21. By the rotation of the main shaft 13, the feed shaft 21 rocks.

The adjustable eccentric mechanism shown in FIG. 1 is entirely conventional and is not itself a part of the present invention, and could for example be the adjustable eccentric mechanism disclosed in Covert U.S. Pat. No. 2,851,976, or that disclosed in Marchesi U.S. Pat. No. 4,469,039. The conventional eccentric mechanism of FIG. 1 merely effects limited reciprocal rotational movement of the feed shaft 21 through a predetermined angular distance synchronously with and in response to rotation of the main shaft 13. In particular, rotation of the main shaft 13 and an eccentric thereon causes the rod 20 to reciprocate linearly and horizontally, the end 20A thereof in turn effecting a rocking movement of the crank 22 and of the feed shaft 21 secured thereto. The button 14 can be pressed to permit adjustment of the angular orientation of the eccentric relative to the main shaft 13, in order to adjust the phase difference between the synchronously moving shafts.

To the main shaft 13 is also fixed another eccentric ring 13A (FIG. 4) which is disposed in a hole 24 in the lifting rocker. The lifting rocker 23 is pivotally supported by an eccentric pin 25 on a fork link 26 which is supported rotatably by the feed shaft. By the rotation of said eccentric ring 13A, the lifting rocker rocks up and down around the eccentric pin 25 which pivots slightly about the feed shaft 21. Here, by adjusting the rotary movement of the eccentric pin 25, the inclination of the lifting rocker 23 and the inclination of a feed dog to be described later are adjusted. In another embodiment, the lifting rocker 23 axially receives a block, and said block is slidably engaged into the transverse guide groove. By this, on rotation of the eccentric ring, the lifting rocker slides up and down around the block while sliding the block along the guide groove.

The lifting rocker 23 is also provided with plain grooves 27 and 28 on both right and left sides thereof. The main feed bar 29 and the differential feed bar 30 respectively slidably fit into these plain grooves. By pressing the main feed bar 29 fitted into the plain groove 27 against a fitting bar 32 fixed to the body, pressing of the main feed bar itself and its position setting in the axial direction of the main shaft are obtained. Onto the fitting bar 32 a pair of pins 34 are secured with screws 33. Each pin projects through a slot 36 of the main feed bar 29, a slot 37 of the lifting rocker 23, and a slot 38 of the differential feed bar 30. A holding plate 40 is secured to the opposite end with a set screw 41 to axially hold the differential feed bar 30. Each of the slots 36, 37, and 38 is formed with a sufficient size so that the pins 34 do not interfere with the above-mentioned movements of the feed bars 29 and 30 and the lifting rocker 23 and are, preferably being formed as large as possible but to a degree so as not to impair the strength of the material. These slots are not only necessary for fixing the holding plate 40 but are also useful for minimizing the weights of each feed bar and the lifting rocker.

The main feed bar 29 is connected with the feed shaft 21 by means of a main crank 43 and a link 44 the crank 43 being fixed by a bolt 42 to the shaft 21. By the rocking of the main crank 43, the main feed bar 29 reciprocates via the link 44 in the plain groove 27 of the lifting rocker 23, and causes the main feed dog 47 secured to it with a set screw 46 to move back and forth. To the differential feed bar 30 an end of a link 51 is pivotally supported by means of a bolt 50 which extends through the slot 49 of the holding plate 40, and the other end of the link is adjustable along an arcuate slot 54 provided in an arm 53 which is fixed to the feed shaft 21 by means of a bolt 52, and in particular is pivotally supported on a guide pin 57 which can be fixed at a desired position along slot 54 by a set screw 56 via an indicator 55. When the arm 53 rocks, the differential feed bar 30 reciprocates in the plain groove 28 via the link 51 to cause a differential feed dog 60 secured to it with a set screw 59 to move back and forth. And, the feed amount is adjusted by shifting the guide pin 57 along the slot 54 by unscrewing the set screw 56. Such a feed amount adjusting mechanism is a mechanism generally used and well known in the differential feed sewing machine art, similar to the above-mentioned mechanism of using an eccentric ring and adjusting the feed amount of the main feed dog by changing the amount of eccentricity of the eccentric ring.

Figure 3:
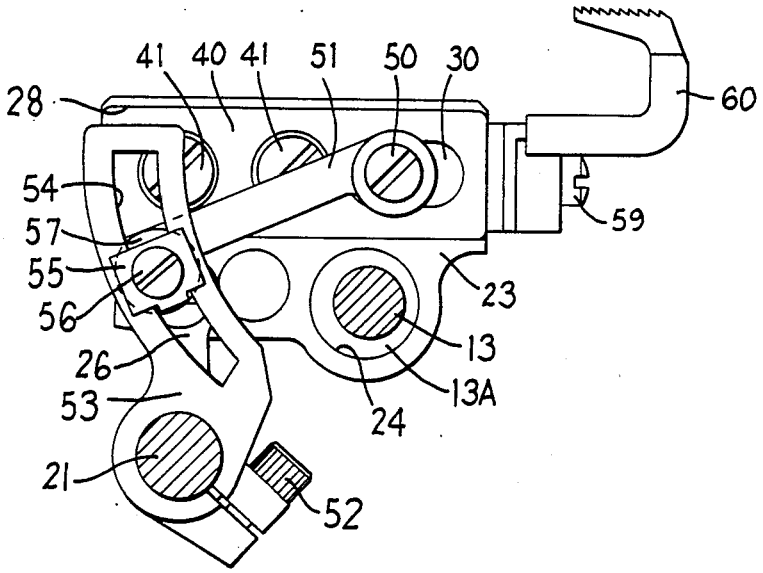
FIG. 3 is an end view of the differential feed mechanism shown in FIG. 2.

Summarizing, rotation of the main shaft 13 and eccentric 13A causes the lifting rocker 23 to pivot about the pin 25 as the right end thereof in FIG. 4 reciprocates up and down, and also causes the lifting rocker 23 to reciprocate horizontally, the pin 25 reciprocating horizontally as the link 26 reciprocally pivots through a limited angular displacement relative to the feed shaft 21. Meanwhile, the feed shaft 21 is being angularly reciprocated independently of the link 26 by the eccentric mechanism shown in the right portion of FIG. 1, which causes the crank 43 (FIG. 5) and arm 53 (FIG. 3) fixedly secured thereon to reciprocally pivot through a predetermined angular displacement, which in turn moves the links 44 and 51 and causes the feed bars 29 and 30 having the feed dogs 47 and 60 thereon to reciprocate horizontally relative to the lifting rocker 23 in synchronism with each other and with the up and down movement of the lifting rocker 23. The length of the stroke of the feed bar 29 is predetermined, while the length of the stroke of the feed bar 30 can be adjusted by using the setscrew 56 to adjust the position of the guide pin 57 along the slot 54.

What is claimed is:

1. A feed mechanism for a sewing machine, comprising:

a lifting member which is vertically reciprocated by a rotating eccentric and has parallel and approximately horizontally extending first and second guide grooves arranged in opposite sides thereof so that, in the region of said grooves, said lifting member has an approximately I-shaped cross-section;

a main feed bar which has thereon a main feed dog, is supported slidably in said first guide groove, and is operatively coupled to a feed shaft by first link means;

a differential feed bar which has thereon a differential feed dog, is supported slidably in said second guide groove, and is operatively coupled to said feed shaft by second link means;

each said link means being coupled to the associated feed bar on a side surface of such feed bar facing away from the lifting member; and a fitting member which is fixedly secured on the sewing machine and slidably engages said side surfaces of said feed bars.

2. The feed mechanism for a sewing machine according to claim 8, wherein said lifting member is pivotally supported by a pin provided on a link, said link being rotatably supported on said feed shaft.

3. The feed mechanism for a sewing machine according to claim 1, wherein said sewing machine includes an outwardly projecting cylinder bed having said feed mechanism therein.

4. The feed mechanism for a sewing machine according to claim 3, wherein said feed mechanism effects movement of a fabric in a direction approximately normal to the direction in which said cylinder bed projects outwardly from said sewing machine.

5. The feed mechanism for a sewing machine according to claim 1, wherein said fitting member includes a fitting bar which is fixedly secured to the sewing machine and which slidably engages one of said feed bars, and a holding plate which is supported on a pin projecting outwardly from said fitting bar and through slots formed in said feed bars and said lifting member and which slidably engages the other of said feed bars.

6. The feed mechanism for a sewing machine according to claim 1, wherein said lifting member has a circular opening extending horizontally therethrough and said rotating eccentric is rotatably disposed in said opening; including a link element which is pivotally coupled to said lifting member and which is rotatably supported on said feed shaft; wherein said lifting member, main feed bar and differential feed bar have slots therethrough; and wherein said fitting member includes a pin which extends through said slots in said lifting member, main feed bar and differential feed bar, a holding member which is fixedly secured to one end of said pin and slidably engages said side surface of said differential feed bar, and a fitting bar which is fixedly secured to an end of said pin remote from said holding member, which slidably engages said side surface of said main feed bar, and which is fixedly secured on the sewing machine.

7. The feed mechanism for a sewing machine according to claim 6, wherein said feed shaft rotationally reciprocates through a predetermined angular displacement, and has a crank and an arm fixed thereon and extending radially outwardly therefrom, wherein said first link means includes a first link member which is pivotally supported at one end on said main feed bar and is pivotally supported at its other end on said crank at a location spaced radially outwardly from said feed shaft, and wherein said second link means includes a second link member which is pivotally supported at one end on said differential feed bar and is pivotally supported at its other end on said arm at a location spaced radially outwardly from said feed shaft.

8. The feed mechanism for a sewing machine according to claim 7, wherein said second link means includes means for adjusting the location at which said other end of said second link member is pivotally supported on said arm in a manner permitting variation of the radial distance between said feed shaft and said other end of said second link member.

* * * * *

UNITED STATES PATENT AND TRADEMARK OFFICE

CERTIFICATE OF CORRECTION

PATENT NO. : 4 674 426

DATED : June 23, 1987

INVENTOR(S) : Takashi KASUDA et al

It is certified that error appears in the above-identified patent and that said Letters Patent is hereby corrected as shown below:

Column 4, line 33; change "claim 8" to ---claim 1---.

Signed and Sealed this

Nineteenth Day of January, 1988

*Attest:*

DONALD J. QUIGG

*Attesting Officer*

*Commissioner of Patents and Trademarks*